United States Patent [19]

Moser

[11] 4,254,732

[45] Mar. 10, 1981

[54] ROLL FUSER APPARATUS AND RELEASE AGENT METERING SYSTEM THEREFOR

[75] Inventor: Rabin Moser, Fairport, N.Y.

[73] Assignee: Xerox Corporation, Stamford, Conn.

[21] Appl. No.: 946,939

[22] Filed: Sep. 29, 1978

[51] Int. Cl.[3] ..... B05C 11/00

[52] U.S. Cl. ..... 118/60; 219/216

[58] Field of Search ..... 118/60, 258, 261, 262, 118/203; 432/75, 228; 134/1 NQ; 184/1 NQ; 427/22; 355/3 FU; 219/216, 469; 101/1 NQ

[56] References Cited

U.S. PATENT DOCUMENTS

| | | | |
|---|---|---|---|
| 11,997 | 5/1902 | Thomson et al. | 118/203 X |
| 1,846,856 | 2/1932 | Francis | 118/258 |
| 2,623,495 | 12/1952 | Johnson | 118/262 X |
| 3,031,872 | 5/1962 | Kusters | 118/203 X |
| 3,647,525 | 3/1972 | Dahlgren | 118/262 X |
| 3,687,109 | 8/1972 | Egnaczak | 118/262 X |
| 3,861,861 | 1/1975 | Thettu | 432/59 |
| 3,918,397 | 11/1975 | Thettu | 118/60 |
| 4,011,353 | 3/1977 | Okamoto et al. | 118/60 |

*Primary Examiner*—Morris Kaplan

[57] ABSTRACT

A heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The heated fuser roll is characterized by an outer layer or surface which by way of example is fabricated from a silicone rubber, Viton or metal clad with a low surface energy material such as Teflon to which a low viscosity polymeric release fluid is applied. Liquid release fluid is contained in a sump from which it is applied either directly or indirectly to the fuser roll. When release agent is applied directly to the fuser roll an air seal must be used on the surface of the fuser roll to insure that the release material contacts the fuser roll. Alternatively, when the release fluid is applied indirectly as by, for example, a metering roll, then the air seal contacts the metering roll.

4 Claims, 3 Drawing Figures

ROLL FUSER APPARATUS AND RELEASE AGENT METERING SYSTEM THEREFOR

BACKGROUND OF THE INVENTION

This invention relates generally to xerographic copying apparatus, and more particularly, it relates to the heat and pressure fixing of particulate thermoplastic toner by direct contact with a heated fusing member having a release fluid on the surface thereof.

In the process of xerography, a light image of an original to be copied is typically recorded in the form of a latent electrostatic image upon a photosensitive member with subsequent rendering of the latent image visible by the application of electrotoscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset". Splitting occurs when the cohesive forces holding the viscous toner mass together is less than the adhesive forces tending to offset it to a contacting surface such as a fuser roll. It will be appreciated that it is not always possible to control the heat transferred to the toner.

Even if the energy transfer could always be controlled, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon, to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid Teflon outer surface or covering of the aforementioned arrangement.

Silicone based oils can also be used with fuser rolls having an outer layer of silicone rubber or Viton (trademark of E. I. duPont). Functional silicone oils can also be used with the foregoing type rolls as well as with metal and glass rolls.

The application of the oil to the surface of the fuser roll can be effected directly by rotating the fuser roll through a quantity of the release fluid which is contained in a sump or indirectly by an applicator roll rotating through the fluid and contacting the fuser roll.

It has been observed that rotation of a roll through the release fluid above a certain speed causes an air layer to form between the release fluid and the fuser roll resulting in non-uniform release agent application.

BRIEF SUMMARY OF THE INVENTION AND PRIOR ART

In accordance with various embodiments of the invention to be discussed hereinafter, the above-mentioned air layer which forms between the fuser roll and the release fluid contained in the sump is prevented by the provision of an air seal which may comprise a wick, blade or other similar structure which is biased into contact with the fuser roll surface. The wick etc. is at least partially immersed but may be totally immersed in the release fluid as can be seen from the drawings forming a part of this specification. In this manner the air layer which begins to form at the initial point of contact between the release fluid and the fuser roll is interrupted and thus prevented beyond the point of contact of the wick, etc, with the fuser roll surface. The foregoing can be more readily visualized by considering a single reference point on the surface of a fuser roll which is supported so that it is partially immersed in release fluid. When the roll is rotated in a clockwise direction as viewed from one end thereof, the aforementioned point, which initially is not contacting the release fluid, eventually contacts the fluid. This point of contact corresponds to the aforementioned "initial point of contact" mentioned above. The wick etc. is supported such that it is contacted by the reference only after the reference point has contacted the release fluid. An important feature of this invention resides in the substantially continuous contact between the air seal and the fuser roll. To this end, bias means are provided to insure such contact, otherwise the air layer would get past the point of contact by moving the wick etc. out of contact with the fuser roll surface. U.S. Pat. No. 3,929,096 discloses a fuser apparatus having a wiper blade 60 lying on the surface of a fuser roll which is rotated through a sump of release fluid. This patent also discloses a cleaning roll which is supported for rotation in contact with a fuser roll. Neither the wiper blade nor the cleaning roll 64 is illustrated as being biased into contact with the surface of the fuser roll such that contact therebetween is continuously assured.

DETAILED DESCRIPTION OF THE PREFERRED EMBODIMENT OF THE INVENTION

Figure 1:
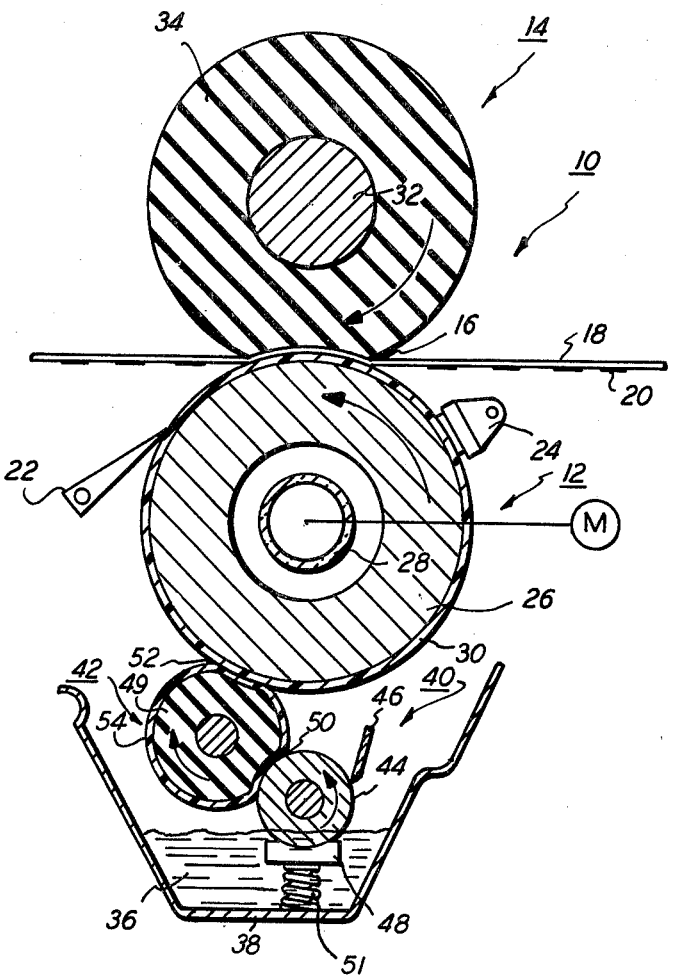
FIG. 1 is a schematic side elevational view of a roll fuser apparatus representing one embodiment of the invention.

Referring now to the figures, it can be seen that the invention is directed to a roll fuser apparatus generally indicated 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structure in a well known manner to create pressure therebetween resulting in the deformation of the backup roll structure by the heated roll structure to thereby form the nip 16.

As the substrate passes out of the nip, it is stripped from the heated roll structure by a plurality (only one shown) of air stripping devices 22 after which it is free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, on the order of 375°–400° F.

The heated roll structure 12 comprises a hollow cylinder 26 having a radiant quartz heater 28 disposed in the hollow thereof. When suitably energized via the aforementioned circuitry, the heating element radiates heat to the cylinder which is then conducted to the outer surface of an outer layer 30 of the structure 12 which preferably comprises Viton having a thickness of 0.008 in.

The backup roll structure 14 comprises a solid metal core 32 to which is adhered a relatively thick layer 34 of deformable material for example an elastomer known as ethylene-propylene terpolymer which is based on stereosperific linear typolymers of ethylene, propylene and small amounts of non-conjugated diene which is commonly referred to as EPDM which layer carries a thin overcoat of PFA. Due to the construction of the backup roll structure it is deformed by the harder heated roll structure when the required pressure is applied therebetween, the pressure being a function of the desired deformation which corresponds to the desired length of the nip 16.

While the layer 30 tends to be adhesive, therefore, exhibits a low affinity for the toner material 20, it has been found desirable to coat the layer with a release agent material 36 contained in a sump 38. The material 36 comprises a polymeric release agent having functional groups such as carboxy, hydroxy, epoxy, ammo, isogenate, thioether or mercepto groups.

For the purpose of coating the heated roll structure 12 there is provided a release agent applying mechanism generally indicated 40. The mechanism 40 comprises a donor roll 42, metering roll 44, doctor blade 46 and a wick 48.

The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a steel-surfaced roll having a 4–32 AA finish. The metering roll has an outside diameter of 0.75 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) of the metering roll 44 in this manner the donor roll 42 comprises a deformable layer 49 which forms a first nip 50 between the metering roll and the donor roll and a second nip 52 between the latter and the heated roll. The nips 50 and 52 also permit satisfactory release agent transfer between the rolls and roll structure. Suitable nip lengths are 0.10 inch.

A wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

A suitable bias member is employed and may comprise a simple spring device 51. The bias member seems to effect substantially continuous engagement between wick etc. and the fuser roll surface to thereby preclude the air layer from forming between the wick, etc. and the fuser at an area beyond the air seal in the direction of rotation. Alternatively, the bias member 51 could be omitted and the biasing provided through a bias means associated with the sump housing 38.

The wiper blade 46 preferably fabricated from Viton is $\frac{3}{4}\times\frac{1}{8}$ in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy.

The donor roll 42 has an outside diameter of 0.313 inch when the metering roll's outside diameter equals 0.75 inch. It will be appreciated that other dimensional combinations will yield satisfactory results. For example, 1.5 inch diameter rolls for the donor and metering rolls have been employed. The deformable layer 49 of the donor roll preferably comprises silicone rubber. However, other materials may also be employed.

A thin sleeve 54 on the order of several mils, constitutes the outermost surface of the roll 42, the sleeve material comprises Teflon. While the donor rolls may be employed without the sleeve 54, it has been found that when the sleeve is utilized, contaminants such as lint on the heated roll 12 will not readily transfer to the metering roll 44. Accordingly, the material in the sump will not become contaminated by such contaminants.

Figure 2:
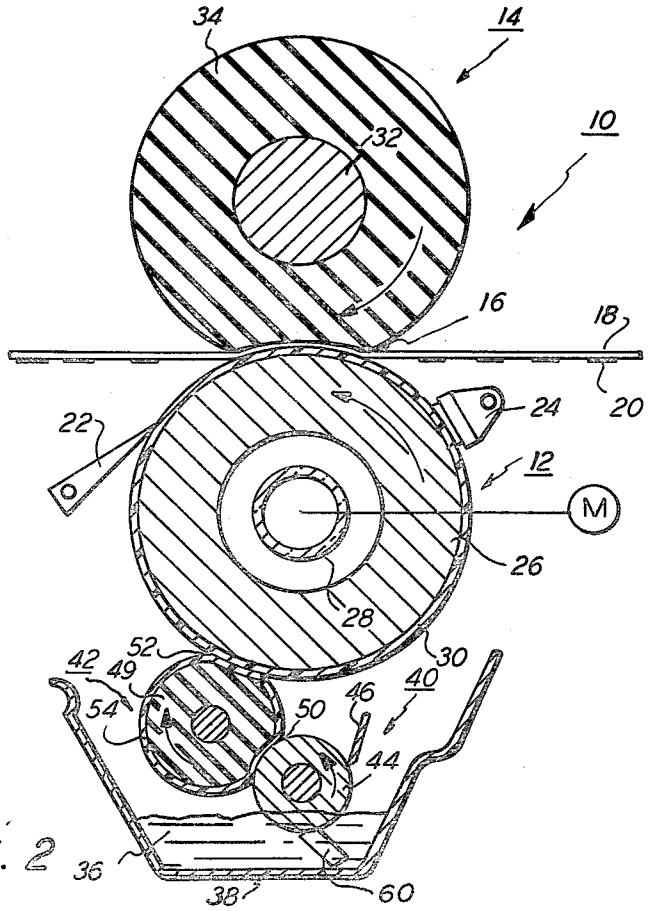
FIG. 2 is a schematic side elevational view of a roll fuser apparatus representing a modified embodiment of this invention.

As illustrated in FIG. 2, a modified form of the invention comprises an air seal 60 in the form of a blade of elastomeric material, for example, Viton. Its dimensions are such that it is relatively stiff and can, therefore, be readily biased into engagement with the roll 42 by means of bias member 62.

Figure 3:
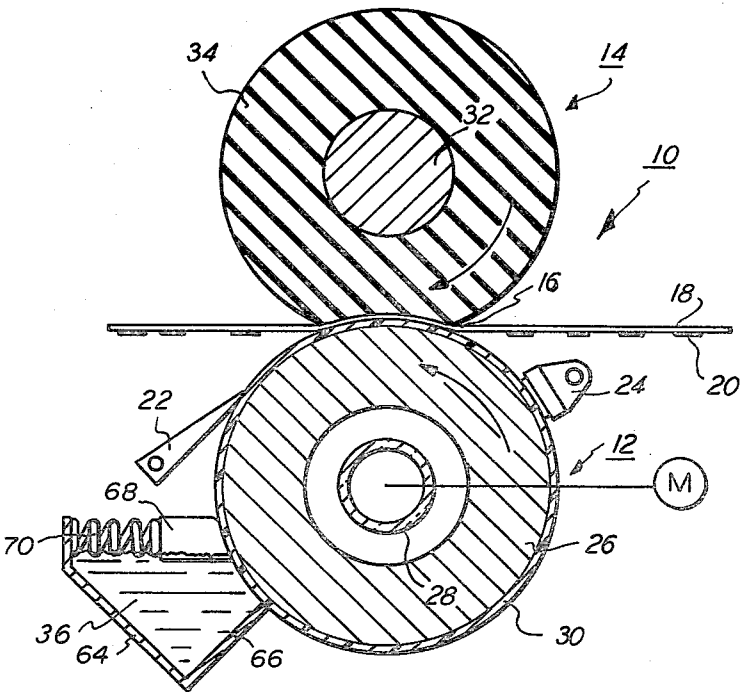
FIG. 3 is a third modification of the invention.

The release material 36 as shown in FIG. 3 is applied directly to the fuser roll 12 by virtue of the roll being rotated in contact with the release fluid. A sump 64 comprises a sealing member 66 at the lower portion thereof. An air seal in the form of wick 68 and associated bias member 70 are provided as shown and serve the same function as the wick 48 and blade 60.

What is claimed is:

1. Roll fuser apparatus wherein a pair of rolls form a nip, through which copy substrates pass with the image side contacting a heated one of the rolls and liquid release material is applied to the surface of the heated roll by means of a release agent management system comprising a rotating roll partially immersed in the release material, contained in an open end sump and a blade contacting the portion of the roll not immersed in said release material the improvement comprising:

an air seal at least partially immersed in said release material; and means for urging said air seal into frictional engagement with the surface of said rotating roll and maintaining such engagement, whereby an air layer is prevented from forming between said roll and at least a part of said release fluid.

2. Apparatus according to claim 1 wherein said air seal comprises a wick.

3. Apparatus according to claim 2 wherein said urging means comprises spring means.

4. Apparatus according to claim 3 wherein said wick is coextensive with the longitudinal extent of said rotating roller.

* * * * *